United States Patent [19]

Valiyee et al.

[11] Patent Number: 4,732,300

[45] Date of Patent: Mar. 22, 1988

[54] PREMIXED BEVERAGE DISPENSER

[75] Inventors: Mojtaba Valiyee, Moraga; William A. Martindale; Richard A. Martindale, both of Vacaville, all of Calif.

[73] Assignee: Automatic Bar Controls, Inc., Vacaville, Calif.

[21] Appl. No.: 24,227

[22] Filed: Mar. 10, 1987

[51] Int. Cl.[4] ..... B67D 5/60

[52] U.S. Cl. ..... 222/144.5; 222/484; 277/167.5; 251/357

[58] Field of Search ..... 277/167.5; 251/357; 137/594; 222/129, 132, 135–136, 144.5, 145, 478, 481–482, 505–506, 509, 511, 518

[56] References Cited

U.S. PATENT DOCUMENTS

| | | | |
|---|---|---|---|
| 2,356,089 | 8/1944 | Rice | 251/357 X |
| 2,937,792 | 5/1960 | Firstenberg | 222/144.5 |
| 2,971,090 | 2/1961 | Piet et al. | 251/357 X |
| 3,085,783 | 4/1963 | Pulling | 251/357 X |
| 3,144,967 | 8/1964 | McClain | 222/144.5 |
| 3,216,445 | 11/1965 | Cornelius | 137/594 |
| 3,252,633 | 5/1966 | Clarke | 222/482 |
| 4,497,421 | 2/1985 | Schilling | 222/144.5 |
| 4,619,378 | 10/1986 | de Man | 222/144.5 |

*Primary Examiner*—Joseph J. Rolla

*Assistant Examiner*—Michael S. Huppert

*Attorney, Agent, or Firm*—Townsend and Townsend

[57] ABSTRACT

A beverage dispensing apparatus for dispensing premixed carbonated beverages from a single beverage dispensing head, the premixed beverages being supplied to a dispenser head by conduits connected to individual premixed beverage sources. The dispenser head consists of a handle having an upper surface portion. The dispenser head has a plurality of channels therethrough, each connected at one end to the conduit and discharging the premixed beverage at the other end. The channel has a tapered portion, which is generally parallel to the upper surface of the dispenser head. A valve is received within the tapered portion and includes a stemmed poppet having a stem at one end and a biasing member which urges the poppet toward the taper so as to seal the valve. The valve is actuated by an obtusely angled lever, having a first portion generally parallel to the first surface of the dispenser head and a second portion, operatively coupled to and essentially perpendicular to the poppet stem. A pushbutton, located proximate to the first surface of the dispenser head, is operatively coupled to the first portion of the lever. The valve on the dispenser head may be opened when the pushbutton is depressed, which causes the second lever portion to slidably engage the poppet stem.

1 Claim, 6 Drawing Figures

PREMIXED BEVERAGE DISPENSER

BACKGROUND OF THE INVENTION

The present invention relates to a beverage dispensing apparatus for dispensing premixed beverages from a single beverage dispensing head, the premixed beverages being supplied to the head through a number of hoses each connected to the respective individual premixed beverage sources.

Hand-held beverage dispensers provide the operator with the ability to dispense several different types of beverages from a single hand-held beverage dispensing head. Hand-held beverage dispensers are very popular for use in bars, where a bartender is frequently required to quickly and efficiently dispense a large number of beverages. By using a hand-held beverage dispenser, a bartender can dispense several types of beverages from a single dispenser head merely by pushing a different button corresponding to the desired beverage.

Hand-held beverage dispensers generally fall into two categories: premixed beverage dispensers and postmixed beverage dispensers. Postmixed beverage dispensers dispense beverages from a single beverage dispensing head by mixing soda water and syrup in the dispenser head. An example of such a beverage dispensing apparatus is shown in U.S. Pat. No. 4,619,378 to de Man. This patent discloses an apparatus for dispensing beverages from a pressurized source of syrup and soda to be mixed in and discharged from a beverage dispensing head. Premixed dispensing devices dispense premixed beverages directly from the beverage supply. No mixing is required prior to dispensing, as is the case in postmixed beverage dispensers. An example of a premixed beverage dispensing system is shown in U.S. Pat. No. 3,216,445 to Cornelius. The Cornelius beverage dispenser dispenses premixed carbonated beverages through a dispenser head which is connected to supply conduits running to the individual premixed beverage supplies. Both premixed and postmixed beverage supplies are in widespread application.

Since premixed beverage dispensers are primarily used to dispense carbonated beverages, effervescent foam generated upon the dispensing of the beverage presents a problem. Generation of excessive foam upon dispensing of the beverage is inefficient and annoying since the operator must stop dispensing the beverage so as to allow the foam to subside. The foam is created by turbulence in the flow of the carbonated beverage through the dispenser channel. In postmixed dispensers this turbulence is desirable since the turbulent churning of syrup and soda water mixes the beverage as it passes through the dispenser head. In premixed dispensers, however, it is desirable to reduce, or eliminate altogether, turbulent flow, so that the amount of foam generated is minimal. Turbulent flow is typically created in prior art beverage dispensers by perpendicular or essentially perpendicular changes in the direction of flow as the beverage traverses the channel through the beverage head. Thus, it is highly desirable to eliminate wherever possible abrupt angular changes of flow direction in order to minimize foaming of the dispensed beverage.

Indeed, postmixed prior art dispensers such as those shown in U.S. Pat. No. 4,497,421 to Schilling, U.S. Pat: No. 4,619,378 to Giampa, and the patent to de Man, noted above, all show dispenser heads having abrupt angular changes in flow direction. Of course, since these three references teach postmixed dispensers, the creation of turbulent flow within the dispenser head is a desirable object for reasons already discussed. However, none of the dispensers would perform satisfactorily as premixed dispensers. The abrupt perpendicular changes in the direction of flow would create substantial turbulence and generate an unacceptable amount of foam.

An existing premixed beverage dispenser such as the dispenser shown in the patent to Cornelius realizes the problem of reducing the number of abrupt angular changes in order to minimize foaming. However, in order to reduce such abrupt angular changes in flow direction, the Cornelius apparatus locates the valve actuating buttons so that the buttons are axially coincident with the valve poppets. This design is exceptionally awkward since the operator is required to "reach over" the dispenser head with his forefinger in order to press the appropriate dispenser button. It would be more desirable to place the buttons in a location on the dispenser head more conveniently proximate to the operator's fingers.

Turbulent flow is also created in the prior art by incidence of the beverage over the surface of conventional valve poppets when the valve is opened and the beverage is dispensed. Conventional poppets include an O-ring groove which is machined or molded about circumference of the poppet. In order to accommodate dimensional tolerances of the o-rings and provide for efficient loading, the o-ring groove is machined or molded wider than the cross-sectional diameter of the o-ring. As a result, gaps exist on either side of the o-rings which disrupt the otherwise smooth surface of the poppet. These discontinuities along the surface of the poppet create localized turbulent regions along the flow path of the beverage and result in foaming of the beverage as the beverage is dispensed.

Another problem with existing premixed dispensers is the difficulty and inconvenience encountered in servicing the valve seal of the individual valve elements in the beverage dispenser head. Most premixed beverage dispensers contain several channels having individual valves for each channel which control the flow of beverages in that channel. With repeated use, the seals on the valves degenerate and the seal becomes insecure, resulting in the beverages leaking out of the dispenser head. Periodic maintenance of the valve seals maintains the integrity of the valve seal. This maintenance consists principally of replacing the o-rings on the individual valve poppets. Existing valve poppets are typically of unitary construction having a circumferential groove which accommodates an o-ring. Further, to replace the o-ring, the old o-ring is removed and a replacement o-ring is rolled over the length of the poppet and seated in the groove. This conventional loading technique can result in the o-rings being seated "inside out" in the groove as a result of being rolled over the length of the poppet. The resulting distortion presents a potential for aggravating the foaming problem.

SUMMARY OF THE INVENTION

The present invention is directed to a beverage dispenser apparatus for dispensing premixed beverages from a premixed beverage supply. The beverage dispenser is connected through several conduits to each of a number of premixed beverage supplies. The dispenser head has a handle portion with an upper surface and essentially cylindrical spigot portion having a plurality of spigots disposed at an obtuse angle with respect to the upper surface. The dispenser head has a plurality of channels with one end connected to the conduit and the other end used to discharge the premixed beverage through the respective spigots. The channel has a tapered portion having wide end coupled to the conduit. The tapered portion includes a valve stem bore which axially extends beyond the narrow end of the tapered portion and is generally parallel to the upper surface of the dispenser head. The dispenser head also includes a lever seat proximate to the valve stem bore.

A valve is located in the first portion of the channel. The valve includes a poppet, which has a stem at one end and a biasing means. The poppet stem is received within the valve stem bore. The biasing means urges the poppet towards the narrow end of the tapered portion of the channel so as to seal the channel.

The valve is actuated by a lever, which is bent at an obtuse angle, defining a first portion and a second portion. The first portion of the lever is generally parallel to the first surface of the dispenser head. The second portion of the lever, which is operatively coupled to the poppet stem, is generally perpendicular to the poppet stem. The second portion is pivotally connected to the dispenser head at the respective lever seat. A plurality of pushbuttons are each located proximate to the first surface and operatively coupled to the respective first lever portion. The valve in the dispenser head causing the second lever portion to operatively engage the poppet stem urging the poppet towards the wide end of the tapered portion of the channel. This inwardly directed motion of the poppet breaks the valve seal in the first portion of the channel and permits the flow of the beverage over the poppet and through the channel in the spigot.

In one embodiment of the invention, the poppet may be easily disassembled. The poppet is comprised of two portions, a first rounded portion, which is attached to the spring in the dispenser head channel, and a second stemmed portion, which is received within the valve stem bore. The first and second portions of the o-ring are interlockably coupled. Moreover, the first and second portions of the poppet each has a concave contour at the interlocking end which corresponds to the contour of the o-ring. An o-ring is seated between the first and second valve portions and may be easily removed by uncoupling the first and second portions. This permits the operator to easily change the o-ring seal, when servicing the bar dispenser unit. Since the o-rings are fitted into the concavity created by the the interlocking poppet components, the o-ring becomes an integral part of the assembled poppet. This design creates a smooth, uninterrupted surface which minimizes turbulent flow as the beverage flows over the surface of the poppet. Moreover, since the o-ring does not have to be rolled over the surface of the poppet to be installed, the probability that the o-ring was installed "inside out" is eliminated and yet another turbulence generating aspect of the poppet is likewise eliminated.

The present invention minimizes foaming of the dispensed carbonated beverages while, at the same time, permits the location of the dispenser buttons proximate to the operator's fingers. In order to minimize abrupt angular chances in flow direction so as to minimize foaming, the axes of the valves must angularly coincide with the direction of beverage flow as the beverage enters the channel in the dispenser head. Positioning the pushbuttons proximate to the operator's fingers will result in the pushbuttons being axially perpendicular to the valves. The convenient location of the dispenser pushbuttons is facilitated by use of the obtusely angled levers within the dispenser head. Use of the angled levers permits location of the pushbuttons along a surface which is generally parallel with respect to the axes of the valves and within convenient proximity to the operator's fingers. This configuration is exceptionally desirable in application since the dispenser head is substantially more convenient to operate and eliminates the clumsy pushbutton configuration employed in the prior art. Moreover, the unique lever system employed in the present invention provides for smoother and easier button action.

The invention also facilitates easy and efficient service of the valve poppets in each of the channels in the beverage dispenser while at the same time assuring a tight seal between the o-ring and the groove in the poppet. The poppet with two interlocking portions enables the poppets to be easily disassembled and a new o-ring inserted in the space between the two portions of poppet. This permits a quick and inexpensive means for servicing the beverage dispenser. When the beverage dispenser is serviced, the o-rings on the poppets may be easily changed. This enhances the integrity of the seals within each of the individual valves and prevents the beverages from leaking out of the beverage dispenser head.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE DRAWINGS

Figure 1:
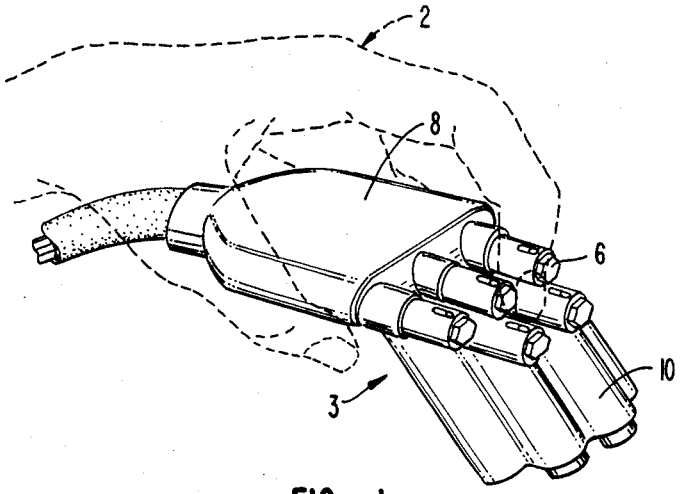
FIG. 1. PRIOR ART
FIG. 1 is an isometric view of the prior art Cornelius beverage dispenser.

FIG. 1 shows a prior art premixed beverage dispenser 3. The operator's hand 2 is shown in phantom. The beverage dispenser 3 is connected to conduit 4 which leads to several premixed beverage supplies, not shown. The beverages are dispensed by pushing buttons 6 which are disposed axially with regard to the the conduits 4. The premixed beverage is dispensed through a spigot 10 which corresponds to the beverage desired to be dispensed. The prior art design is disadvantageous since the operator must reach over the dispenser head with his forefinger to actuate the dispenser button 6.

This configuration is extremely awkward to use. It is infinitely more desirable to place the pushbuttons in location proximate to the operator's finger so as to eliminate the necessity of having the operator reach over the dispenser head with his forefinger.

Figure 2:
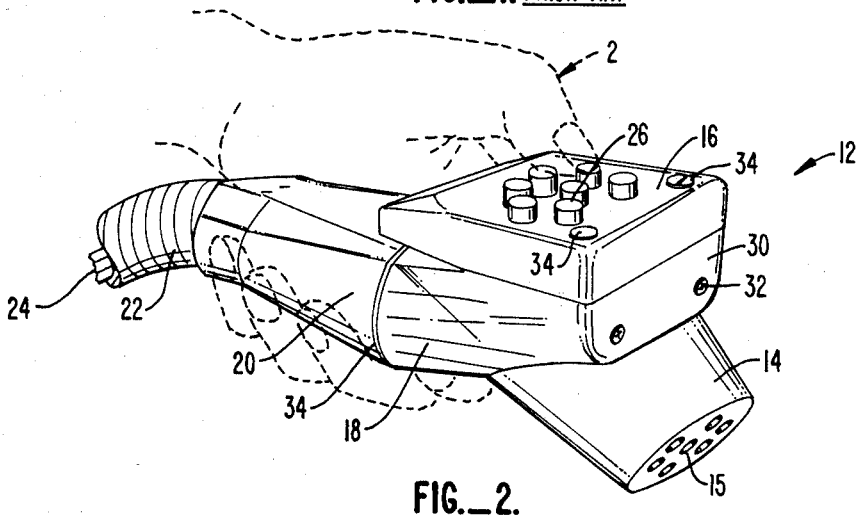
FIG. 2 is an isometric view of the preferred embodiment of the present invention.

FIG. 2 is an isometric view of the preferred embodiment of the present invention. Dispenser head 12 is connected to conduits 24 which run to individual premixed beverage supplies, not shown in FIG. 2. The conduits 24 are themselves encased in a flexible casing 22, which is attached to dispenser head 12. Dispenser head 12 includes body 18 which is, in the preferred embodiment, of unitary plastic construction. Body 18 includes a spigot portion 14 having several dispenser outlets 15 disposed at the end of the spigot portion 14. Upper plate 16 is attached to body 18 by screws 34. Several buttons 26 are positioned upon the top surface of upper plate 16. Each of the buttons 22 corresponds to a different beverage which the dispenser head 12 may dispense, In the preferred embodiment on the invention, the upper plate 16 is equipped with seven buttons 26, since, in the preferred embodiments, the dispenser dispenses seven different types of beverages. A front plate 30 is attached to body 18 by screws 32. The front plate 30 can be removed to access the internal valve mechanisms of the dispenser head 12 by removing screws 32. A metal back plate 34 is attached to body 18 by screws not shown in FIG. 2. A conduit housing 20 is attached to the body 18 by screws, not shown in FIG. 2. The conduit housing 20 may be removed to access the back plate 34 and conduits 24 as they enter dispenser body 18. When the dispenser 12 is serviced, the conduit housing 20 may be removed to inspect the condition of the conduits 24 or to remove the back plate 34 in order to access the internal valve mechanisms, not shown in FIG. 2.

In operation, the dispenser head 12 is held in the palm of the operator's hand 2, shown in phantom in FIG. 2. The body 18 and conduit housing 20 are grasped by the operator between the thumb and forefinger and held securely in operator's palm with the operator's remaining fingers. The thumb is held proximate to upper plate 16 so as to have access to the buttons 26. To dispense a desired beverage, the operator places the spigot housing 14 over a glass or container, not shown in FIG. 2, into which the beverage is to be dispensed. The operator then presses the button 26 corresponding to the beverage which the operator desires to dispense into the glass or container, not shown in FIG. 2.

Figure 3:
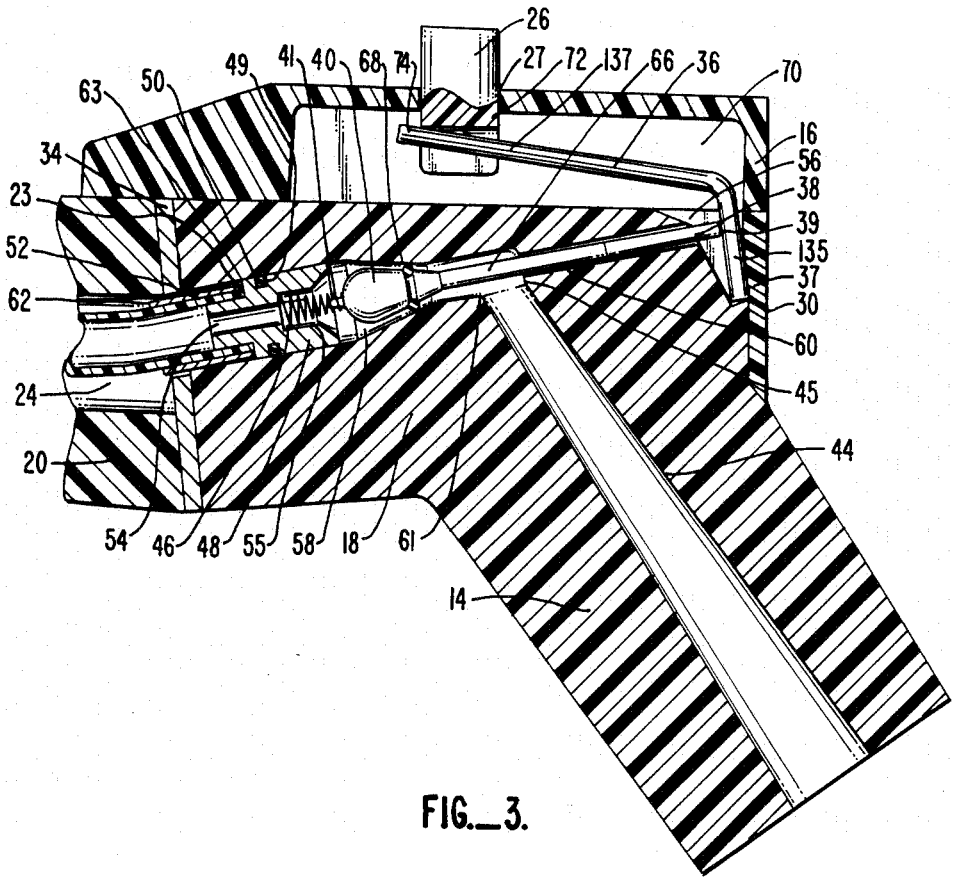
FIG. 3 is an enlarged cross-sectional view of the preferred embodiment of the invention.

FIG. 3 is a cross-sectional side elevation of a portion of dispenser head 12 showing the internal mechanism of one of the dispenser units. It should be understood that each beverage to be dispensed from the dispenser head 12 requires an individual mechanism such as that shown in FIG. 3. Hence, in the preferred embodiment of the invention, as shown in FIG. 2. there would be seven such mechanisms, such as that shown in FIG. 3. Referring to FIG. 3, dispenser head 18 has a valve seat channel 58, which is in the shape of a venturi channel. A valve stem bore 60 extends from the narrower end 61 of the valve seat channel 58 through body 18 and into lever channel 56. Dispenser nozzle 44 is connected at an obtuse angle to valve seat channel 58 at point 45. The taper of the nozzle 44 and the angular connection to the narrower end 61 of the valve seat channel 58 reduce turbulent flow in operation by eliminating the necessity of having the beverage traverse a right angle. This reduction in turbulent flow is especially desirable when dispenser head 12 is used to dispense the carbonated beverages, since increased turbulent flow results in a foaming of the dispensed beverage. Conduit 24 is connected to nippled bushing 48 at nipple 52. Conduit 24 is secured to nipple 48 by crimp clamp 62 which is positioned about the circumference of the end 23 of conduit 24 and crimped to insure a tight seal between conduit 24 and nipple 52. Nippled bushing 48 has groove 49 about its circumference. An o-ring 50 is placed in groove 49. Nippled bushing 48 is of a slightly smaller diameter than valve seat channel 58, so that nippled bushing 48 may be snugly received within valve seat channel 58. Nippled bushing 48 is placed in valve seat channel 58 at the wider end 63 of the valve seat channel 58. The o-ring 50 provides a seal between nippled bushing 48 and the wall of valve seat channel 58. This seal prevents fluid contained within the valve channel 58 from leaking out of the wider end 63 of valve seat channel 58. Nippled bushing 48 has a channel 54 bored axially therethrough. An enlarged channel portion 55 accommodates a spring 46. Spring 46 is connected to poppet 40 and axially held in position with the poppet 40 by poppet protrusion 41 which is placed roughly at the radial center of spring 46.

Figure 5:
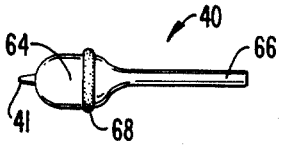
FIG. 5 is a side elevation of one of the poppets employed in the preferred embodiment of the present invention.
Figure 5A:
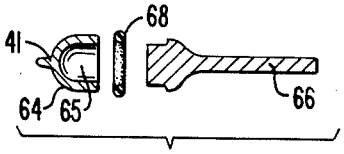
FIG. 5A is a cross-sectional side elevation of one of the poppets in a disassembled condition.

Poppet 40, shown in detail in FIG. 5, has leading portion 64 interlockably connected, not shown, to stemmed portion 66. An o-ring 68 is placed in a circumferential groove, not shown, between leading portion 64 and stemmed portion 66. Leading portion 64 has protrusion 41 for engagement by the spring 46 not shown in FIG. 5. FIG. 5A is a cross-sectional view of a disassembled poppet 40. Leading portion 64 has cavity 65. Stemmed portion 66 has a protrusion 67 which corresponds in diameter to cavity 65. Both the leading portion 64 and the stemmed portion 66 are concavely contoured to correspond with the contour of o-ring 68. This contouring of the portions 64 and 66 assures a secure seal between o-ring 68 and the portions 64 and 66. The o-ring 68 is placed about the circumference of protrusion 67. The remaining portion of protrusion 67 is then snapped into place within cavity 65. The poppet 40 is hydrodynamically styled so as to minimize turbulent flow over the surface of the poppet 40. This reduction in turbulent flow is highly desirable when the beverage dispenser is used to dispense carbonated beverages, since the foaming of the carbonated beverages is greatly reduced when turbulent flow is minimized.

Referring again to FIG. 3, the poppet 40 is seated in valve seat channel 58 such that the stem portion 66 is received within the valve stem bore 60. The spring 46 applies a bias on the poppet 40 directed outwardly toward front plate 30 such that the poppet 40 is urged toward the valve stem bore 60. The application of the outwardly directed bias by spring 46 causes the o-ring 68 on poppet 40 to circumferentially contact the inner surface of the valve seat channel 58, thereby sealing the valve seat channel 56 and preventing the flow of any liquid past the o-ring seal 68.

Valve linkage rod 38 is likewise received within valve stem bore 60 and is in abutting engagement with valve stem 66 of the poppet 40. The valve linkage rod 38 protrudes into lever channel 56. Lever 36 is pivotally seated in groove channel 56, such that lever 36 is capable of pivoting about a fixed point 37. The lever 36 is bent at an obtuse angle. The obtuse bend in lever 36 defines a shorter portion 135 proximate to the valve linkage rod 38 and a longer portion 137 proximate to the upper plate 16. The shorter portion 135 of lever 36 slidably engages the valve linkage rod at the end 39 of the valve linkage rod 38. Upper plate 16 is itself outfitted with a grooved channel 70 which receives the longer portion 137 of the lever 36. The upper plate 16 has an aperture 27 through which a pushbutton 26 is inserted. The pushbutton 26 has a groove 72 cut across its diameter. The groove 72 of button 26 slidably engages the end 74 of the longer portion 137 of lever 36. The use of the valve linkage rod 38 in combination with lever 36 provides a smooth valve action when the operator depresses pushbutton 26.

Figure 4:
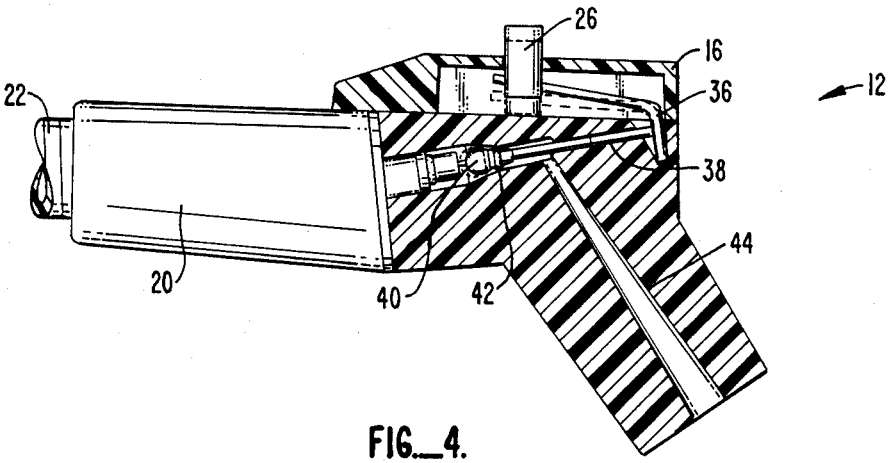
FIG. 4 is a side elevation in partial cross section of the preferred embodiment of the invention.

Thus, to actuate the valve of dispenser head 12 the operator pushes button 26, as shown in FIG. 2. Referring to FIG. 4, the button is pushed downwards, as shown in phantom in FIG. 4. This causes the longer portion 137 lever 36 to move toward the body 18 within the upper plate lever channel 70. Likewise, the shorter portion 135 of the lever 36 moves toward the body 18 within lever channel 56. The shorter portion 135 of the lever 36 slidably engages the valve linkage rod 38 pushing the valve linkage rod 38 inward towards the poppet 40. This, in turn, urges the poppet 40 rearward toward nippled bushing 48. The seal created by o-ring 68 is broken and the beverage, which is under pressure, is permitted to flow through valve seat channel 58 toward the narrow end 45 of nozzle 44. The beverage, in turn, flows through nozzle 44 and into the desired container, not shown. When the button 26 is released, the bias applied to poppet 40 by spring 46 urges the poppet 40 forward toward valve stem bore 60. Again, o-ring 68 circumferentially contacts the surface of valve seat channel 58 creating a seal and restricting further flow of the beverage into the nozzle 44.

It should be understood that a dispenser head 12, as shown in FIG. 2, may have one or more of the above-described valve mechanisms, shown in detail in FIG. 3.

Modification and variation can be made to this disclosed embodiment without departing from the subject matter of the invention as defined in the following claims.

What is claimed is:

1. A beverage dispenser for dispensing premixed beverages from a premixed beverage supply having a conduit connected to the beverage supply comprising:

a dispenser head having a handle portion with an upper surface and a spigot portion having a plurality of spigots disposed at an obtuse angle with respect to the upper surface, said dispenser head having a plurality of channels therethrough generally parallel to said upper surface and adapted at one end to be connected to the conduit and at the other end to discharge the premixed beverage through the respective spigots, each said channel having a tapered portion having a wide end adapted to be coupled to the conduit and a valve stem bore axially extending beyond the narrow end generally parallel to said upper surface, said dispenser head further including a lever seat proximate to each said valve stem bore;

a plurality of valve means each received within said tapered portion of the respective channels, each of said valve means including a poppet having a stem at one end received within said valve stem bore and a biasing means urging said poppet towards the narrow end of the tapered portion of said channel so as to normally seal said channel, each said poppet including a poppet assembly for supporting an o-ring seal, said poppet assembly having first and second members, said first member having a cylindrical protrusion adapted to receive the o-ring and an annular axially directed concavity circumscribing the cylindrical protrusion and adapted to be flush with the o-ring, said second member having a cylindrical cavity adapted to mate with the cylindrical protrusion of the first member, the second member having an axially directed concavity facing the concavity of the first member so that an o-ring secured therebetween provides a continuous surface with the first and second members to minimize turbulence in the premixed beverage flow over the poppet; and a plurality of valve actuating means each including a lever having a first portion and a second portion disposed at an obtuse angle with respect to each other, said first lever portion being generally parallel to said first surface of said dispenser head, said second lever portion being generally perpendicular to the associated poppet stem and operatively coupled thereto, said second portion being further pivotally connected at the respective lever seat to said dispenser head, said valve actuating means also including a plurality of pushbuttons disposed proximate to said first surface and operatively coupled to the first lever portions of the respective levers so that depression of a pushbutton causes the second lever portion of the associated lever to operatively engage the associated poppet stem thereby urging said poppet toward the wide end of said first portion of the associated channel to dispense the desired beverage.

* * * * *